US007817029B1

(12) United States Patent
Hillenburg et al.

(10) Patent No.: US 7,817,029 B1
(45) Date of Patent: Oct. 19, 2010

(54) METHOD FOR REMOTE PRE-VERIFICATION OF ALARM SIGNALS AND REMOTE ALARM SYSTEM CONTROL

(75) Inventors: Mark A. Hillenburg, Springfield, MO (US); Rick A. Britton, 4009 W. 150th St., Leawood, KS (US) 66224; Kyle Heironimus, Springfield, MO (US)

(73) Assignee: Rick A. Britton, Lenexa, KS (US)

( * ) Notice: Subject to any disclaimer, the term of this patent is extended or adjusted under 35 U.S.C. 154(b) by 332 days.

(21) Appl. No.: 11/906,157

(22) Filed: Sep. 28, 2007

Related U.S. Application Data

(63) Continuation-in-part of application No. 11/901,951, filed on Sep. 19, 2007.

(60) Provisional application No. 60/847,982, filed on Sep. 28, 2006, provisional application No. 60/845,704, filed on Sep. 19, 2006.

(51) Int. Cl.
*G08B 23/00* (2006.01)

(52) U.S. Cl. ..... 340/501; 340/506; 340/541; 379/45; 455/404.1; 455/414.1; 455/414.14

(58) Field of Classification Search ..... 340/501, 340/506, 539.1, 540, 541, 286.01, 286.05, 340/825.49; 379/37, 38, 45; 455/404.1, 455/414.1, 414.4
See application file for complete search history.

(56) References Cited

U.S. PATENT DOCUMENTS

| | | | | |
|---|---|---|---|---|
| 6,667,688 | B1 * | 12/2003 | Menard et al. | 340/531 |
| 6,759,956 | B2 * | 7/2004 | Menard et al. | 340/539.19 |
| 6,781,509 | B1 * | 8/2004 | Oppedahl et al. | 340/286.01 |
| 6,847,293 | B2 * | 1/2005 | Menard et al. | 340/539.1 |
| 6,943,682 | B1 * | 9/2005 | Dowens et al. | 340/506 |
| 7,528,711 | B2 * | 5/2009 | Kates | 340/506 |

* cited by examiner

*Primary Examiner*—Davetta W Goins
(74) *Attorney, Agent, or Firm*—Jonathan A. Bay

(57) ABSTRACT

A method of alarm data communication involves protecting a premise with an alarm sensor, sensing an exception, text messaging a responsible user's text-messaging device a text message indicative of such exception and, in the absence of an effective cancel instruction, propagating a signal to a central alarm monitoring station indicative of such exception or otherwise expediting dispatch of authorities to the premise in response to such exception. Another aspect of this method involves that, notwithstanding the absence of an effective cancel instruction, there instead might be the issuance of an effective verify instruction, which propagates to the central alarm monitoring station as indicative of not only the exception but also that such exception is verified.

20 Claims, 5 Drawing Sheets

METHOD FOR REMOTE PRE-VERIFICATION OF ALARM SIGNALS AND REMOTE ALARM SYSTEM CONTROL

CROSS-REFERENCE TO RELATED APPLICATION(S)

This application claims the benefit of U.S. Provisional Application No. 60/847,982, filed Sep. 28, 2006.

This application is also a continuation-in-part of U.S. patent application Ser. No. 11/901,951, filed Sep. 19, 2007, which claims the benefit of U.S. Provisional Application No. 60/845,704, filed Sep. 19, 2006; and U.S. Provisional Application No. 60/847,982, filed Sep. 28, 2006.

All the foregoing disclosures are incorporated herein by this reference.

BACKGROUND OF THE INVENTION

1. Field of the Invention

This invention relates to a user's interaction with an electronic security system and, more particularly, to a provision which provides the user the ability to interact with the alarm system via messaging on a cell phone or other device that receives and sends text messages.

A non-limiting example utilization of the invention includes but is not limited to the pre-verification of alarm signals. Such pre-verification of alarm signals shall, not only reduces the incoming alarm-signal traffic to a central alarm monitoring station but also, reduce false alarms, reduce costs and speeds up the response time of the authorities dispatched by the central alarm monitoring station.

A number of additional features and objects will be apparent in connection with the following discussion of the preferred embodiments and examples with reference to the drawings.

2. Prior Art

When a premise-protection alarm system trips, it not only begins to ring bells or sirens on the protected premise but it also immediately transmits an alarm signal to a central alarm monitoring station. Briefly, a premise-protecting alarm system comprises an alarm control panel housing a central processing unit (CPU) as well as other circuitry including one or more communications link(s) to the central alarm-monitoring station, a network of sensors reporting to the CPU, one or more communications link(s) to the central alarm-monitoring station, and a keypad for entering inputs such as high-level programming or basic commands like Arm, Disarm, Extend Schedules, Delete User Code and so on. The keypad may be mounted on a wall by a doorway, and remote from the control panel which might be hidden in a closet or the like.

As a matter of terminology, the 'initiating' cause which causes any of the numerous sensors to (in turn) cause the alarm system to trip is referred to as an "exception." Not all exceptions are alarm events. Some are accidental trips.

It is typical for alarm systems to be configured such that, when an exception occurs (and an alarm trips), an alarm signal is transmitted to the central alarm-monitoring station without regard to the accuracy or appropriateness of the alarm signal itself. The central alarm monitoring station has a staff of operators, and one responsible operator ("central station operator") seeks to call the premise to verify the alarm. If no one can be contacted there, the central station operator begins to call the "Call List" looking for an authorized person to either verify the alarm, or authorize the central alarm monitoring station to refrain from dispatching the authorities. If no contact is made, the central station operator will follow the pre-set policy of the central alarm monitoring station, which is most likely to dispatch the authorities. The preceding is what the central alarm monitoring station does without any specific knowledge of the initiating event.

So again, when an exception occurs (and the alarm trips), an alarm signal is transmitted to the central alarm monitoring station (and without regard to the accuracy or appropriateness of the alarm signal). The point of repeating the foregoing is that, there is no way for anybody responsible for the premise and/or alarm system therefor to know about the alarm until the alarm has been transmitted to central alarm monitoring station, and one of its central station operators there is trying to verify the alarm by a telephone call.

The central station operator begins by calling the hard-wired phones at the premise. If no one is there to answer, the central station operator proceeds to call numbers on the Call List. Who the central station operator is attempting to call may be referred to as a "Key Holder," or anyone else from the list of people that the central alarm monitoring station has on its "Call List" for alarms from that premise.

The current prior-art practice only allows for the Key Holder (or other persons on the Call List) to be informed of an alarm—or interact with the alarm system—through the central station operator. In other words, the central station operator is the bridge between the protected premise's alarm system and the person answering the telephone call from the central station operator. This current state of matters proves to be time consuming, costly and cause delays or miss-communication which causes false alarms. It also proves to be expensive for all parties involved.

At the point of contact from the central alarm monitoring station, the operator will ask the person—who may or may not be aware of any such initial alarm—if there is an exception or difficulty or other issue that should cause the alarm to transmit. If the central alarm monitoring station cannot contact anyone because, say, the users of the system are not currently in the premise location, the central alarm monitoring station "assumes worst case" and dispatches the proper authorities. This pre-set policy of "assuming the worst case" in many instances results in a false dispatch, when, if the user could have been contacted, then the false dispatch could have been averted. In fact if the user could have been contacted BEFORE the alarm was sent to the central alarm monitoring station, then perhaps a false alarm could be averted more often than not.

What is needed is an improvement to overcome the foregoing shortcomings of the prior art.

Now to turn to another matter, currently, remote command of alarm systems is only available through expensive voice modules or software applications that run on computer systems connected through dial-up modems. The only way to remotely control an alarm control panel is by connecting up to the alarm control panel with one of these two means and then thereafter initiating functions of the alarm system. This process is cumbersome, inconvenient, and not conducive to the modern lifestyle which is so much on the go and has become treated to these days with so many portable conveniences.

What is needed is an improvement to overcome the shortcomings of the prior art in this matter as well.

SUMMARY OF THE INVENTION

The following comprises a list of terms or elements and brief definitions therefor.

User: The owner or administrator or person who is operating the alarm system.

Verify: To double check or validate that an alarm report is authentic. Verification of alarms is generally accomplished by calling the premise and talking with the user or whoever answers the phone to confirm if this person concurs with the report that the security system is reporting.

Cancel: To countermand an alarm report. Cancellation of alarms is generally accomplished by the central alarm monitoring station calling the premise and talking with a properly authenticated, authorized user to determine if the alarm report is unworthy of involving the authorities (which can be either police and like public-safety enforcement entities, or other parties responsible for resolution).

Premise: The location, building, or home that an alarm system is installed to protect (this includes ATM machines, a vault, and so on).

Alarm System: An electronic system comprised of a network of sensors that report back to a central processing unit (CPU). The CPU includes a method of communication to a central station receiver. The CPU will communicate when one or more of the logical rules of the CPU or one or more of the sensors are violated in a manner in which the system is preprogrammed to transmit this exception to the central station receiver. Usually the transmission of said exception state (or alarm) means that an unauthorized person or persons are trying to attack the premise in such a way as to cause damage or steal items within the premise or cause harm to the occupants of the premise.

Alarm Control Panel: The housing as well as the central processing unit (CPU) and other circuitry including one or more communications link(s), especially for communications with the central alarm-monitoring station.

Central Station Receiver: The piece of electronic equipment that the Alarm System CPU communicates to at a distant location. The central alarm monitoring station is a command center in which these alarm signals are processed.

Central Station Operator's Screen: Central alarm monitoring stations process alarm signals by displaying them in order of priority via a parsing and routing software application. The software application will display the alarms on an operator's terminal screen, to which the operator will apply policies, accepted best practices and common sense to validate or verify the alarm signal and then communicate that message to the proper authorities or responsible party for resolution.

Text Messaging: A text messaging service is SMS (ie., short message service) or other text-based messaging service that are popular nowadays in many cell phone applications. Text messaging is communicating by such services. A text message is the content communicated across such services.

Text-messaging Device: Any of things including without limitation a cell phone, PDA (eg., personal digital assistant), laptop, interactive software application, or web page capable of handling text messaging/text messages.

Given the foregoing, the following comprises a brief summary of the invention.

It is an object of the invention to provide support in the firmware/software of an electronic, security alarm-system for the transmission of messages directly (or indirectly, as through a service provider) from the alarm control panel to a cell phone (which are presumed to be capable of handling text-based messaging) or other text-messaging device that receives text messages. This thereby allows the user to reply or respond to those messages in a fashion that will affect the way the alarm control panel processes and communicates various alarm signals to the central alarm monitoring station.

It is another object of the invention to allow messages incoming from a cell phone or other text-messaging device into an alarm control panel to thereby initiate various functions within the alarm control panel. Example functions include without limitation Arming, Disarming, Extending Schedules, Deleting User Codes and so on.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIGS. 1 through 6 comprise a set of block diagrams that tile together in ways as indicated by the numbered bubbles and collectively show apparatus and processes in accordance with the invention for carrying out the method in accordance with the invention for remote pre-verification of alarm signals and remote alarm system control, wherein:

DETAILED DESCRIPTION OF THE PREFERRED EMBODIMENTS

Figure 1:
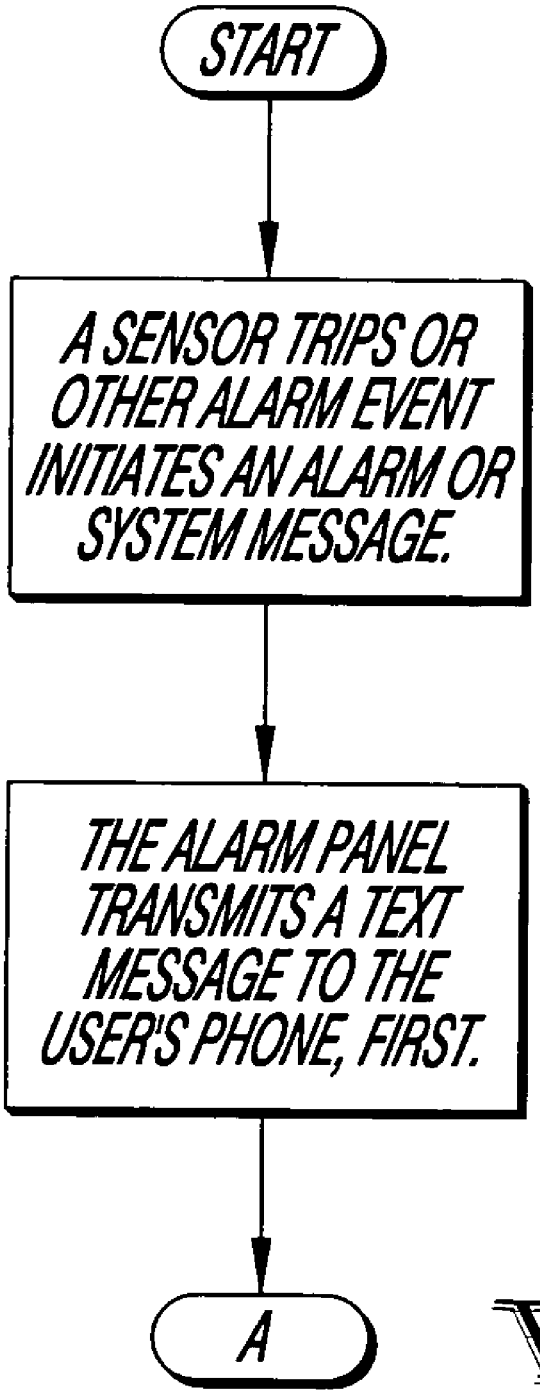
FIG. 1 is an initial block diagram of the set.

There are shown in the drawing certain exemplary embodiments of the invention as presently preferred. It should be understood that the invention is not limited to the embodiments disclosed as examples, and is capable of variation within the scope of the skills of a person having ordinary skill in the art to which the invention pertains.

Figure 2:
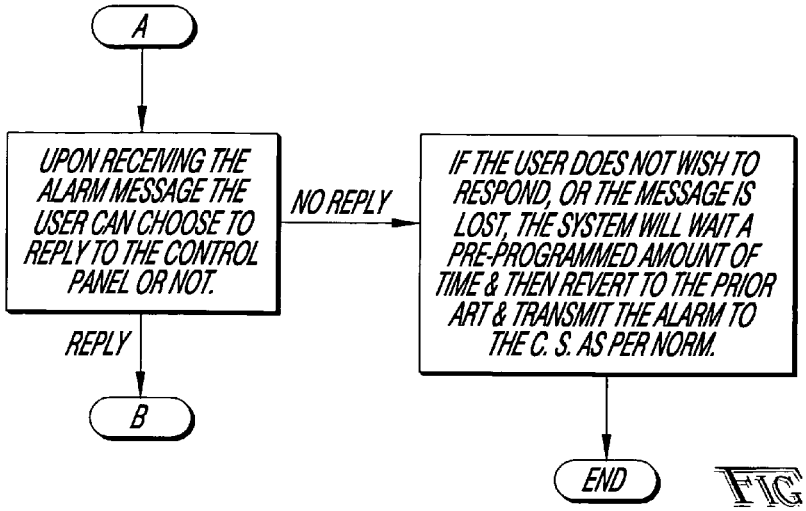
FIG. 2 is a further block diagram of the set.
Figure 3:
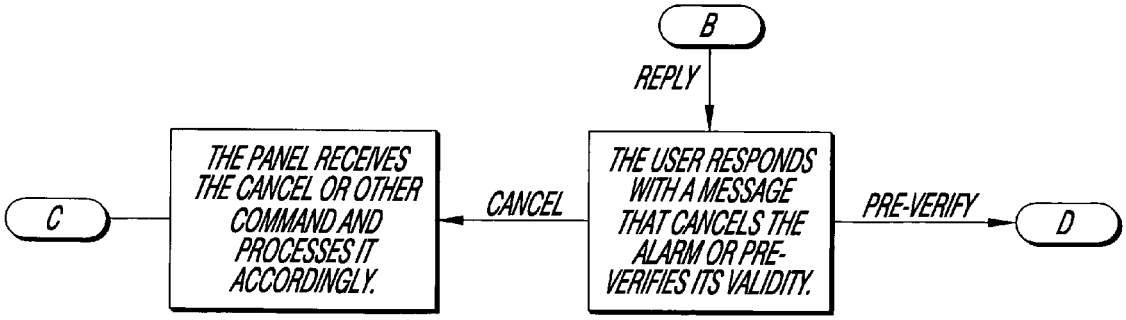
FIG. 3 is an additional block diagram of the set.
Figure 4:
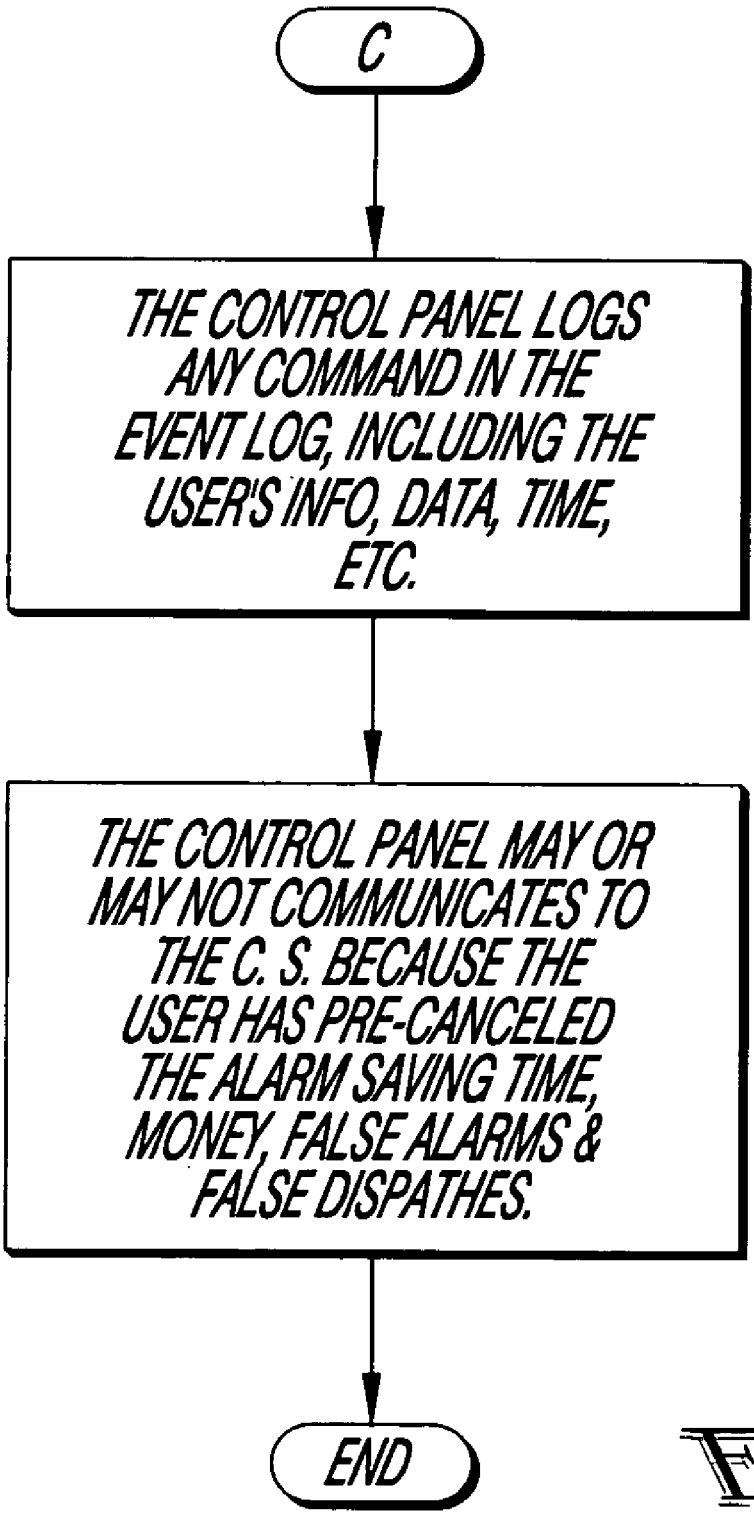
FIG. 4 is another block diagram of the set.
Figure 5:
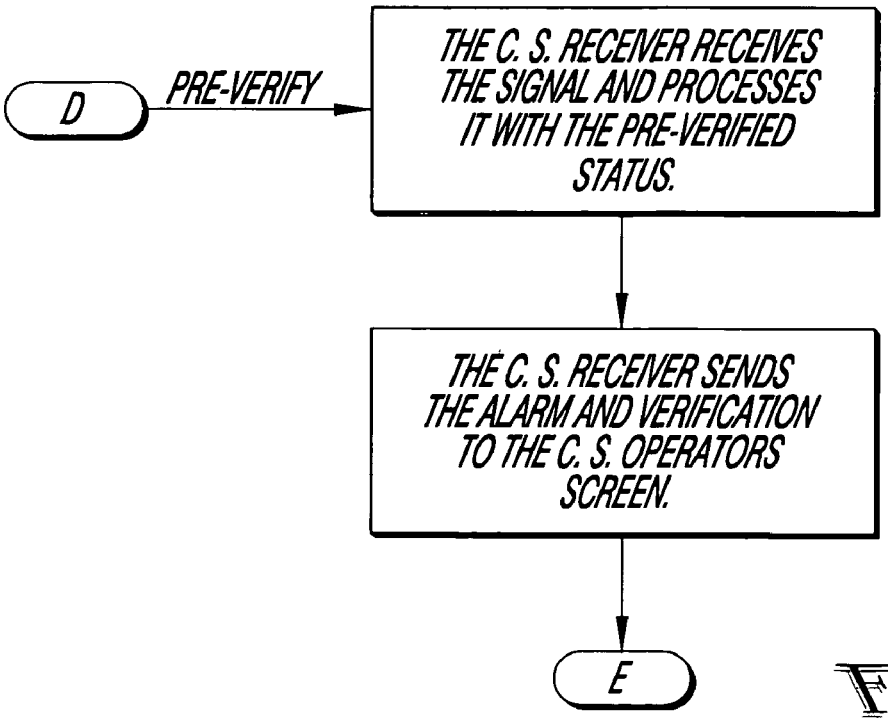
FIG. 5 is still another block diagram of the set.
Figure 6:
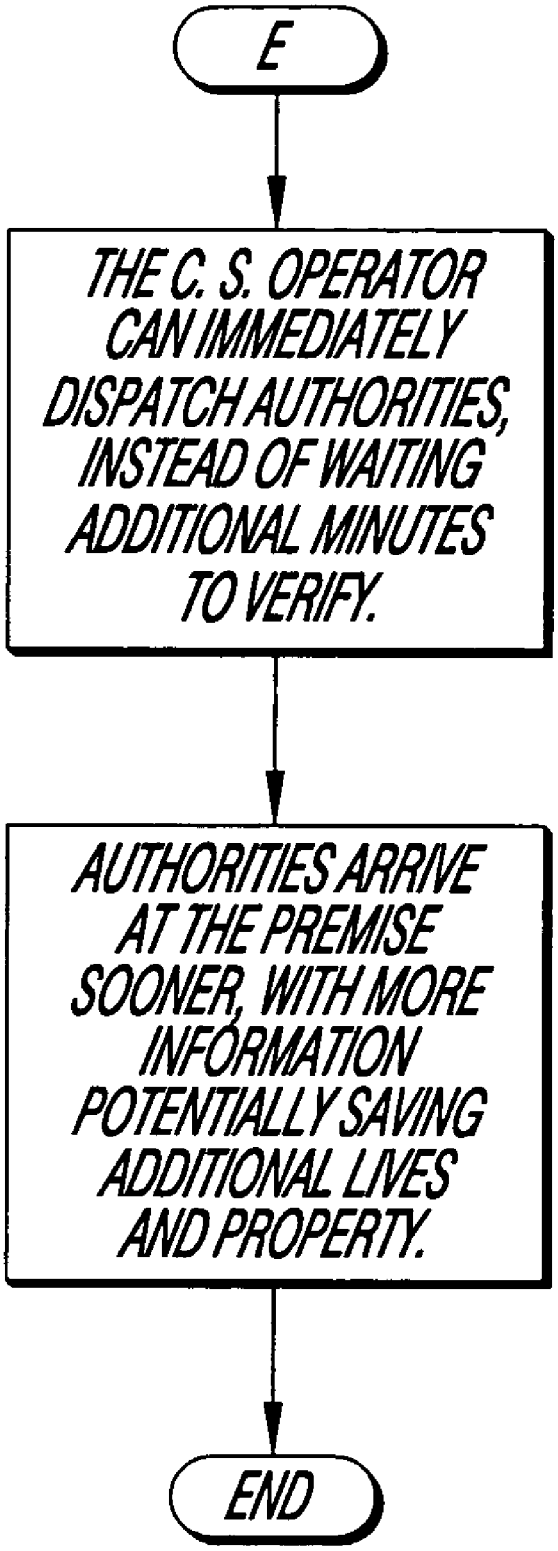
FIG. 6 is one more block diagram of the set.

FIGS. 1 through 6 comprise a set of block diagrams that tile together in ways as indicated by the numbered bubbles and collectively show apparatus and processes in accordance with the invention for carrying out the method in accordance with the invention for remote pre-verification of alarm signals and remote alarm system control.

A system and method in accordance with the invention comprises the creation and immediate transmission of system events and alarm events to the primary user's cell phone or other text-messaging device. This will allow the primary user to respond with one of many commands in which the response will determine how the initiating alarm is processed within the alarm control panel itself, and or communicated to the central alarm monitoring station. The pre-verification of the alarm signal will allow the user to be better informed, have better control of his or her system and eliminate not only false dispatches but eliminate as well the original transmission to the central alarm monitoring station of the false alarm in any event. This functionality will decrease alarm-signal traffic to the central alarm monitoring station, allowing the central alarm monitoring station to concentrate on actual alarms or decrease the number of required operators per account. When an alarm signal is received at the central alarm monitoring station, it will come in with an identifier or flag that will allow the central station operator to know that the alarm has already been pre-verified, or not, allowing the operator or the central station automation software to know immediately how to handle and process the alarm signal.

If an alarm control panel's message is sent to the primary user's message-capable phone or other text-messaging device, and NO response is received back within a programmable amount of time, the alarm control panel will revert to the previous way of doing business, and will transmit the alarm signal to the central alarm monitoring station, except with the inventive difference that the alarm signal will be identified with a flag or other identifier embedded in the alarm signal that the alarm has NOT been pre-verified.

It is an aspect of the invention to configure the alarm control panel to allow users to interface with it via text-based messaging. That way, a user can send commands directly to the alarm control panel in conjunction with his or her authorized code (or other authentication method) and thereby affect the alarm system's functions by transmitting such instructions causing actions including but not limited to: Arming, Disarming, Deleting Users, Extending Schedules, and so on.

The advantages provided by the invention are many and varied, but include that a premise-protecting alarm system and method in accordance with invention allows the end user—the person who has the most amount of information about the source of the alarm signal—to immediately verify or cancel the alarm signal no matter what his or her location, regardless if inside the protected premise or away from it. The prior art systems or methods all require the alarm control panel to communicate to the central alarm monitoring station first, taking many additional minutes and many additional steps (any one of which could be flawed) to verify the origin of the alarm signal in order to make the decision to proceed to act upon it as valid, or cancel it. The system and method in accordance with invention allows users—ones who are authorized and presumptively knowledgeable about the initiation of the alarm—to immediately verify or, in the alternative, cancel the alarm from any location.

It also allows a user to have remote command of and control over his or her alarm system, something previously only available with difficult to operate and expensive voice modules or through a PC interface, or by calling the central alarm monitoring station and requesting a change.

This application is commonly-invented in-part with U.S. Pat. No. 7,239,236 (B1)—Britton, entitled "Wireless sensors for alarm system operations;" U.S. Pat. No. 6,650,238 (B1)—Britton, entitled "Communication path integrity supervision in a network system for automatic alarm data communication;" and, U.S. Pat. No. 6,592,043 (B1)—Britton, entitled "Fixture to mount a miniature proximity transponder to another article," the full disclosures of each of which are incorporated by this reference thereto.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method of alarm data communication, comprising the steps of:

protecting a premise with a premise-sited automatic alarm controller;

providing a remote central station with receiving equipment for receiving data communications from a plurality of alarm data communicators including said premise-sited automatic alarm controller;

providing the premise-sited automatic alarm controller with a network of premise-sited alarm sensors which report premise-related exceptions not to the central station but to said premise-sited automatic alarm controller;

providing one or more communications links between the premise-sited automatic alarm controller and the remote central station's receiving equipment;

providing a user who is responsible for the premise with a cellular text-messaging device;

providing the premise-sited automatic alarm controller with a cellular text-messaging module;

when an exception occurs with any sensor, said sensor reporting the exception to the premise-sited automatic alarm controller;

the premise-sited automatic alarm controller responding with preliminary steps followed by conditional steps;

said preliminary steps comprising:

refraining for a pre-programmed amount of time from a step of sending an exception message to the remote central station's receiving equipment, text messaging the responsible user's text-messaging device a text message indicative of such exception, and waiting a pre-programmed amount of time for the user to respond by text message;

said conditional steps comprising:

(A) if receiving (1) a responsive text message from the user (2) within the pre-programmed amount of time (3) that is indicative of a disarm instruction, then:

(a) disarming, (B) but if not (1), (2) and (3), then:

(b) sending an exception message to the remote central station's receiving equipment;

wherein the step of disarming further comprises logging in an event log onboard the premise-sited automatic alarm controller the instruction from said user to disarm, including date, time, and user identification.

2. The method of alarm data communication of claim 1, wherein the step disarming further comprises:

canceling the step of sending a message to the remote central station's receiving equipment regarding said exception.

3. The method of alarm data communication of claim 2, wherein the step of logging further comprises:

logging in the event log not only date, time and user identification of the user instruction to disarm but also exception sensor identification.

4. The method of alarm data communication of claim 1, wherein steps (A) and (B) comprise:

(A.1) if receiving (1) a responsive text message from the user (2) within the pre-programmed amount of time (3.1) that is indicative of a disarm instruction, then:

(a.1) disarming, (A.2) else if receiving (1) a responsive text message from the user (2) within the pre-programmed amount of time (3.2) that is indicative of a pre-verify instruction, then:

(a.2) sending an exception message to the remote central station's receiving equipment that is associated with a pre-verify indication, (B) but if not (1), (2) and (3.1) or (3.2), then:

(b) sending an exception message to the remote central station's receiving equipment associated with an indication of absence of pre-verified status.

5. The method of alarm data communication of claim 4, further comprising:

providing the remote central station with prioritizing software for prioritizing the messages and/or signals received by the receiving equipment from the plurality of alarm data communicators which include said premise-sited automatic alarm controller; and prioritizing those exception messages of the premise-sited automatic alarm controller that are associated with a pre-verify indication over those without a pre-verify indication.

6. The method of alarm data communication of claim 5, further comprising:

providing the remote central station with human operators and operator interfaces for the prioritizing software to serve the premise-sited automatic alarm controller's exception messages; and identifying or flagging on said operators' interfaces the exception messages of said premise-sited automatic alarm controller that were associated with a pre-verify indication.

7. The method of alarm data communication of claim 1, wherein:

the user's cellular text-messaging device comprises a cellular telephone.

8. A premise-sited automatic alarm controller configured for alarm data communication in accordance with the method of claim 1.

9. A central station with receiving equipment for receiving data communications from a plurality of alarm data communicators including said premise-sited automatic alarm controller configured for alarm data communication in accordance with the method of claim 1.

10. A method of alarm data communication, comprising the steps of protecting a premise with a premise-sited automatic alarm controller;

providing a remote central station with receiving equipment for receiving data communications from a plurality of alarm data communicators including said premise-sited automatic alarm controller;

providing the premise-sited automatic alarm controller with a network of premise-sited alarm sensors which report premise-related exceptions not to the central station but to said premise-sited automatic alarm controller;

providing one or more communications links between the premise-sited automatic alarm controller and the remote central station's receiving equipment;

providing a user who is responsible for the premise with a cellular text-messaging device;

providing the premise-sited automatic alarm controller with a cellular text-messaging module;

when an exception occurs with any sensor, said sensor reporting the exception to the premise-sited automatic alarm controller;

the premise-sited automatic alarm controller responding with preliminary steps followed by conditional steps;

said preliminary steps comprising:

refraining for a pre-programmed amount of time from a step of sending an exception message to the remote central station's receiving equipment, text messaging the responsible user's text-messaging device a text message indicative of such exception, and waiting a pre-programmed amount of time for the user to respond by text message;

said conditional steps comprising:

(A) if receiving (1) a responsive text message from the user (2) within the pre-programmed amount of time (3) that is indicative of a pre-verify instruction, then:

(a) sending an exception message to the remote central station's receiving equipment that is associated with a pre-verify indication, (B) but if not (1), (2) and (3), then:

(b) sending an exception message to the remote central station's receiving equipment associated with an indication of absence of pre-verified status.

11. The method of alarm data communication of claim 10, further comprising:

providing the remote central station with prioritizing software for prioritizing the messages and/or signals received by the receiving equipment from the plurality of alarm data communicators which include said premise-sited automatic alarm controller; and prioritizing those exception messages of the premise-sited automatic alarm controller that are associated with a pre-verify indication over those without a pre-verify indication.

12. The method of alarm data communication of claim 11, further comprising:

providing the remote central station with human operators and operator interfaces for the prioritizing software to serve the premise-sited automatic alarm controller's exception messages; and identifying or flagging on said operators' interfaces the exception messages of said premise-sited automatic alarm controller that were associated with a pre-verify indication.

13. The method of alarm data communication of claim 10, wherein:

the user's cellular text-messaging device comprises a cellular telephone.

14. A premise-sited automatic alarm controller configured for alarm data communication in accordance with the method of claim 10.

15. A central station with receiving equipment for receiving data communications from a plurality of alarm data communicators including said premise-sited automatic alarm controller configured for alarm data communication in accordance with the method of claim 10.

16. A method of alarm data communication, comprising the steps of:

protecting a premise with a premise-sited automatic alarm controller;

providing a remote central station with receiving equipment for receiving data communications from a plurality of alarm data communicators including said premise-sited automatic alarm controller;

providing the premise-sited automatic alarm controller with a network of premise-sited alarm sensors which report premise-related exceptions not to the central station but to said premise-sited automatic alarm controller;

providing one or more communications links between the premise-sited automatic alarm controller and the remote central station's receiving equipment;

providing a user who is responsible for the premise with a cellular text-messaging device;

providing the premise-sited automatic alarm controller with a cellular text-messaging module;

when an exception occurs with any sensor, said sensor reporting the exception to the premise-sited automatic alarm controller;

configuring the premise-sited automatic alarm controller to receive text messages from the responsible user's text-messaging device indicative of instructions to Arm or Disarm; and arming or disarming accordingly;

wherein each instance of the step of arming and disarming further comprises, logging in an event log onboard the premise-sited automatic alarm controller the instruction from said user to arm or disarm, including date, time, and user identification.

17. The method of alarm data communication of claim 16, further comprising:

further configuring the premise-sited automatic alarm controller to receive text messages from the responsible user's text-messaging device indicative of instructions to change Schedules;

changing schedules accordingly;

wherein each instance of the step of changing schedules further comprises, logging in an event log onboard the premise-sited automatic alarm controller the instruction from said user to change schedules, including date, time, and user identification.

18. The method of alarm data communication of claim 16, further comprising:

further configuring the premise-sited automatic alarm controller to receive text messages from the responsible user's text-messaging device indicative of an instruction to Delete a User Code;

deleting a user code accordingly;

wherein each instance of the step of changing schedules further comprises, logging in an event log onboard the premise-sited automatic alarm controller the instruction from said user to delete a user code, including date, time, and user identification.

19. A premise-sited automatic alarm controller configured for alarm data communication in accordance with the method of claim 16.

20. A central station with receiving equipment for receiving data communications from a plurality of alarm data communicators including said premise-sited automatic alarm controller configured for alarm data communication in accordance with the method of claim 16.

* * * * *